US006535225B1

(12) United States Patent
Shintaku et al.

(10) Patent No.: US 6,535,225 B1
(45) Date of Patent: Mar. 18, 2003

(54) DISPLAY DEVICE FOR ADJUSTING AN ANGLE OF VISIBILITY, A DISPLAY DEVICE FOR ADJUSTING CONTRAST, A METHOD OF ADJUSTING AN ANGLE OF VISIBILITY OF A DISPLAY DEVICE, AND A METHOD OF ADJUSTING CONTRAST OF A DISPLAY DEVICE

(75) Inventors: Kenichi Shintaku, Saitama (JP); Shigeru Munetomo, Saitama (JP); Shuichi Horie, Saitama (JP); Jun Sato, Saitama (JP); Toru Yamashita, Saitama (JP); Keiichi Kurihara, Saitama (JP); Takahiro Sasaki, Saitama (JP); Hiroki Narushima, Saitama (JP)

(73) Assignee: Pioneer Corporation, Tokyo (JP)

( * ) Notice: Subject to any disclaimer, the term of this patent is extended or adjusted under 35 U.S.C. 154(b) by 0 days.

(21) Appl. No.: 09/570,937

(22) Filed: May 15, 2000

(30) Foreign Application Priority Data

May 14, 1999 (JP) ..... 11-134719

(51) Int. Cl.[7] ..... G09G 3/36
(52) U.S. Cl. ..... 345/690; 345/89
(58) Field of Search ..... 345/87, 88, 89, 345/91, 95, 101, 589, 601, 611, 617, 690; 348/686, 687, 790, 791, 602, 603

(56) References Cited

U.S. PATENT DOCUMENTS 4,788,588 A * 11/1988 Tomita ..... 345/690
5,109,219 A * 4/1992 Kanstan
5,250,937 A * 10/1993 Kikuo et al. ..... 345/89
6,236,384 B1 * 5/2001 Didier et al. ..... 345/87

FOREIGN PATENT DOCUMENTS

JP 06-332385 * 12/1994

* cited by examiner

*Primary Examiner*—Chanh Nguyen
(74) *Attorney, Agent, or Firm*—Sughrue Mion, PLLC

(57) ABSTRACT

A storage region for storing in advance information on contrast corresponding to an angle formed by an angle adjusting mechanism and a display screen is provided in advance. When adjustment of the information on contrast corresponding to one angle is made, a difference is determined between the information on contrast corresponding to the one angle and stored in advance in the storage region and adjusted information on contrast corresponding to the one angle, and the difference is added to the information on contrast corresponding to the remaining angles and stored in advance, thereby automatically adjusting the contrast corresponding to all the angles. Accordingly, as the user or the like only effects contrast adjustment for one angle, it becomes possible to automatically effect appropriate contrast adjustment and angle-of-visibility adjustment for all directions.

17 Claims, 9 Drawing Sheets

FIG.4A

ADDRESS: θ i

| | |
|---|---|
| #0 | MEMA(0)=15 |
| #1 | MEMA(1)=16 |
| #2 | MEMA(2)=18 |
| #3 | MEMA(3)=21 |
| #4 | MEMA(4)=23 |
| #5 | MEMA(5)=24 |
| ⋮ | ⋮ |

(DIAGRAM ILLUSTRATING A MEMORY MAP OF MEMA)

FIG.4B

ADDRESS: θ i

| | |
|---|---|
| #0 | MEMB(0) |
| #1 | MEMB(1) |
| #2 | MEMB(2) |
| #3 | MEMB(3) |
| #4 | MEMB(4) |
| #5 | MEMB(5) |
| ⋮ | ⋮ |

(DIAGRAM ILLUSTRATING A MEMORY MAP OF MEMB)

FIG.9 PRIOR ART

| ANGLE $\theta$ i | CONTRAST VALUE Mi (INITIAL VALUE) |
|---|---|
| $\theta_0$ | $M_0$ |
| $\theta_1$ | $M_1$ |
| $\theta_2$ | $M_2$ |
| $\theta_3$ | $M_3$ |
| $\theta_4$ | $M_4$ |
| $\theta_5$ | $M_5$ |
| $\theta_6$ | $M_6$ |
| ⋮ | ⋮ |

STATE PRIOR TO ADJUSTMENT

| ANGLE $\theta$ i | 1ST TIME | 2ND TIME | 3RD TIME | 4TH TIME | 5TH TIME | |
|---|---|---|---|---|---|---|
| $\theta_0$ | $CM_0$ | $CM_0$ | $CM_0$ | $CM_0$ | $VM_0$ | |
| $\theta_1$ | $M_1$ | $CM_1$ | $CM_1$ | $CM_1$ | $CM_1$ | |
| $\theta_2$ | $M_2$ | $M_2$ | $CM_2$ | $CM_2$ | $CM_2$ | |
| $\theta_3$ | $M_3$ | $M_3$ | $M_3$ | $CM_3$ | $CM_3$ | |
| $\theta_4$ | $M_4$ | $M_4$ | $M_4$ | $M_4$ | $CM_4$ | |
| $\theta_5$ | $M_5$ | $M_5$ | $M_5$ | $M_5$ | $M_5$ | |
| $\theta_6$ | $M_6$ | $M_6$ | $M_6$ | $M_6$ | $M_6$ | |
| ⋮ | ⋮ | ⋮ | ⋮ | ⋮ | ⋮ | |

STATE DURING ADJUSTMENT

DISPLAY DEVICE FOR ADJUSTING AN ANGLE OF VISIBILITY, A DISPLAY DEVICE FOR ADJUSTING CONTRAST, A METHOD OF ADJUSTING AN ANGLE OF VISIBILITY OF A DISPLAY DEVICE, AND A METHOD OF ADJUSTING CONTRAST OF A DISPLAY DEVICE

BACKGROUND OF THE INVENTION

1. Field of the Invention

The present invention relates to a display device having a section for automatically setting the angle of visibility or contrast of a display screen in correspondence with the angle of the display screen for a user or the like.

2. Description of the Related Art

As is well known, an angle of visibility is present in a display device in the light of its nature. Further, it is experientially known that the visibility of the display screen changes even within the range of the angle of visibility depending on the angle formed by the user's eye line and the display screen.

For example, it is experientially known that, in liquid crystal displays which are used for various electronic appliances as lightweight and thin display devices, a clearest view can be obtained when the angle formed by the user's eye line and the display screen of the liquid crystal display is orthogonal, and that the visibility gradually declines as the display screen is tilted with respect to the user's eye line.

A display device disclosed in JP-A-6-38136 is known as a display device for ameliorating such a change in the visibility corresponding to the angle formed by the user's eye line and the display screen.

This display device is supported by an angle adjusting mechanism, and is provided with an angle detecting section for detecting a tilt angle of the display device with respect to the angle adjusting mechanism as well as a storage section for storing individual contrast data in correspondence with respective tilt angles. If the user tilts the display device, specific contrast data is read out from the storage section in correspondence with the tilt angle detected by the angle detecting section, and the contrast of the display screen is set on the basis of the contrast data.

Further, it is possible to change (adjust) the contrast data in the storage section for each tilt angle. If the user tilts the display device at a desired angle and effects an adjustment operation of the contrast at that tilt angle, the angle detecting section detects the tilt angle, and the storage section replaces the old contrast data corresponding to that tilt angle with newly adjusted contrast data, and stores the same. Accordingly, if the user tilts the display device at the desired angle after adjustment, the display is given with automatically adjusted contrast.

However, with the above-described conventional display device, if the user attempts to adjust the contrast appropriately with respect to a plurality of or all the tiltable angles, it has been necessary to consecutively tilt the display device and repeat the operation of contrast adjustment for the respective tilt angles. For this reason, a complicated operation is required for the user, and it cannot be said that the operational efficiency has been satisfactory.

Namely, the aforementioned contrast adjustment is effected in the procedure shown in the flowchart in FIG. 8. First, when the user tilts the display device at a desired angle (Step S200), this tilt angle θ is detected by the angle detecting section (Step S202). Next, when the user effects an operation for adjusting the contrast to one corresponding to the tilt angle θ (Step S204), the storage section stores the adjusted contrast data in correspondence with the angle θ (Step S206). Then, a determination is made as to whether or not an instruction for termination of the adjustment has been given by the user (Step S208), and if the instruction for termination has not been given, contrast adjustment processing is repeated with respect to another tilt angle θ starting with Step S200. Accordingly, if the user attempts to adjust the contrast with respect to a plurality of tilt angles θ, it has been necessary to change the contrast data one by one by repeating the operation in Steps S200 and S204 a plurality of times.

In other words, contrast adjustment is made as the user updates (rewrites) the contrast data stored in the storage section through a step-by-step operation. For this reason, as shown in FIG. 9, in order to adjust the contrast data (contrast values) $M_0$, $M_1$, $M_2$, . . . , which have already been stored in the storage section in correspondence with the respective tilt angles $\theta_0$,$\theta_1$, $\theta_2$, . . . , to appropriate contrast values $CM_0$, $CM_1$, $CM_2$, . . . , the user must individually perform operations one by one in which the contrast value $M_0$ corresponding to the tilt angle $\theta_0$ is changed to $CM_0$ in a first adjustment operation, the contrast value $M_1$ corresponding to the tilt angle $\theta_1$ is changed to $CM_1$ in a second operation, the contrast value $M_2$ corresponding to a next tilt angle $\theta_2$ is changed to $CM_2$ in a third operation, and so forth. Thus, there has been a problem in that a complicated operation is imposed on the user.

In addition, while the user is performing such a repeated operation, the user's viewing position may become offset. Therefore, there can be cases where, even if the user thinks that he or she is performing the adjustment operation appropriately, the adjustment cannot be done appropriately as a result. Since readjustment is required in such a case as well, there has been a problem in the operational efficiency. Accordingly, because the viewing position is liable to become offset, not only is the operation troublesome, but there has been the problem that appropriate contrast adjustment cannot be effected easily.

SUMMARY OF THE INVENTION

The invention has been devised to overcome the above-described problems of the conventional art, and it is an object of the invention to provide a display device capable of setting an appropriate angle of visibility or contrast in correspondence with the angle of the display screen with respect to the user or the like, and of improving the operational efficiency of angle-of-visibility or contrast adjustment.

To attain the above object, in accordance with a first aspect of the invention, there is provided a display device which has a display screen and is supported by an angle adjusting mechanism, comprising: detecting section for detecting an angle formed by the display screen and the angle adjusting mechanism; and setting section for setting an angle of visibility of the display screen on the basis of information on an angle of visibility corresponding to the angle detected by the detecting section, wherein, in a state in which the display screen is set to one angle with respect to the angle adjusting mechanism, the setting section adjusts the angle of visibility at the one angle by adjusting the information on an angle of visibility corresponding to the one angle, and subsequently adjusts the information on an angle of visibility corresponding to remaining angles, to thereby automatically adjust the angles of visibility corresponding to the remaining angles.

In accordance with the above-described first aspect of the invention, when the user or the like tilts the display screen at one desired angle and gives an instruction for adjusting the angle of visibility to the setting section, the setting section adjusts the angle of visibility of the display screen on the basis of information on an angle of visibility corresponding to the one angle. Further, the setting section automatically effects the adjustment of the angles of visibility corresponding to the remaining angles on the basis of the adjustment value used at the time of the angle-of-visibility adjustment at the one angle. Consequently, as the user or the like merely gives an instruction for the angle-of-visibility adjustment for the one angle, the angle-of-visibility adjustment for the other (remaining) angles is automatically made. Hence, the angle-of-visibility adjustment can be made for all the directions by a simple operation. After the angle-of-visibility adjustment, as the user only tilts the display screen at a desired angle, the display at an appropriate angle of visibility is effected automatically.

In accordance with a second aspect of the invention, there is provided a display device which has a display screen and is supported by an angle adjusting mechanism, comprising: detecting section for detecting an angle formed by the display screen and the angle adjusting mechanism; and setting section for setting an angle of visibility of the display screen on the basis of information on contrast corresponding to the angle detected by the detecting section, wherein, in a state in which the display screen is set to one angle with respect to the angle adjusting mechanism, the setting section adjusts the angle of visibility at the one angle by adjusting the information on contrast corresponding to the one angle, and subsequently adjusts the information on contrast corresponding to remaining angles, to thereby automatically adjust the angles of visibility corresponding to the remaining angles.

In accordance with the above-described second aspect of the invention, it becomes possible for the user or the like to make angle-of-visibility adjustment for all the directions by a simple operation. After the angle-of-visibility adjustment, by merely tilting the display screen at a desired angle, the display at an appropriate angle of visibility is effected automatically.

For example, in a display device for effecting display by means of such as a liquid crystal display, a correlation exists between the contrast and the angle of visibility, and when the user or the like tilts the display screen at one desired angle and gives an instruction for adjusting the contrast, the setting section adjusts the angle of visibility of the display screen on the basis of information on contrast corresponding to the one angle.

Further, the setting section automatically effects the adjustment of the angles of visibility corresponding to the remaining angles by effecting contrast adjustment for the remaining angles on the basis of the adjustment value of the contrast used at the time of the angle-of-visibility adjustment at the one angle. Consequently, as the user or the like merely gives an instruction for the angle-of-visibility adjustment for the one angle, the angle-of-visibility adjustment for the other (remaining) angles is automatically made. Hence, the angle-of-visibility adjustment can be made for all the directions by a simple operation. After the angle-of-visibility adjustment, as the user only tilts the display screen at a desired angle, the display at an appropriate angle of visibility is effected automatically.

In accordance with a third aspect of the invention, there is provided a display device which has a display screen and is supported by an angle adjusting mechanism, comprising: detecting section for detecting an angle formed by the display screen and the angle adjusting mechanism; and setting section for setting the contrast of the display screen on the basis of information on contrast corresponding to the angle detected by the detecting section, wherein, in a state in which the display screen is set to one angle with respect to the angle adjusting mechanism, the setting section adjusts the contrast at the one angle by adjusting the information on contrast corresponding to the one angle, and subsequently adjusts the information on contrast corresponding to remaining angles, to thereby automatically adjust the contrast corresponding to the remaining angles.

In accordance with the above-described third aspect of the invention, when the user or the like tilts the display screen at one desired angle and gives an instruction for adjusting the contrast, the setting section adjusts the contrast of the display screen on the basis of information on contrast corresponding to the one angle. Further, the setting section automatically effects the adjustment of the contrast corresponding to the remaining angles on the basis of the adjustment value used at the time of the contrast adjustment at the one angle. Consequently, as the user or the like merely gives an instruction for the contrast adjustment for the one angle, the contrast adjustment for the other (remaining) angles is automatically made. Hence, the contrast adjustment can be made by a simple operation. After the contrast adjustment, as the user only tilts the display screen at an angle other than the aforementioned one angle, the display with appropriate contrast is effected automatically.

Namely, even with a display device whose angle of visibility does not change, the phenomenon is known in which the visibility of the display screen declines as the angle formed by the eye line of the user or the like and the display screen of the display device changes, and a situation similar to a case in which the angle of visibility is substantially narrowed is brought about by the decline in the visibility. With respect to such a decline in the visibility, a substantially appropriate angle of visibility is set by appropriately adjusting the contrast through the automatic contrast adjustment described above.

In a fourth aspect of the invention, in the display device according to any one of the first to third aspects of the invention, after adjusting the information on an angle of visibility or the information on contrast corresponding to the one angle, the setting section adjusts the information on an angle of visibility or the information on contrast corresponding to the remaining angles on the basis of an adjustment value of the information on an angle of visibility or an adjustment value of the information on contrast corresponding to the one angle as well as initial values which are preset in correspondence with respective variable angles of the display screen.

In a fifth aspect of the invention, in the display device according to the fourth aspect of the invention, the setting section effects the adjustment corresponding to the remaining angles by determining a difference between the adjustment value corresponding to the one angle and an initial value corresponding to the one angle among the initial values and by adding the difference to the respective initial values corresponding to the remaining angles.

In a sixth aspect of the invention, in the display device according to any one of the first, second, fourth, and fifth aspects of the invention, the display device has the display screen based on a liquid crystal display, and the setting section adjusts the orientation of the angle of visibility of the liquid crystal display.

The above and other objects, features and advantages of the present invention will become more apparent from the following detailed description of the invention when read in conjunction with the accompanying drawings.

BRIEF DESCRIPTION OF THE DRAWINGS

FIGS. 4A and 4B are explanatory diagrams illustrating memory maps of storage regions MEMA and MEMB;

FIG. 9 is a diagram for further explaining conventional contrast adjustment operation.

DETAILED DESCRIPTION OF THE PREFERRED EMBODIMENT

Referring now to the accompanying drawings, a description will be given of an embodiment of the invention. It should be noted that, as the embodiment, a description will be given of a display device which is tiltably mounted on an electronic apparatus such as a vehicle-mounted audio system or a vehicle-mounted navigation system.

Figure 1:
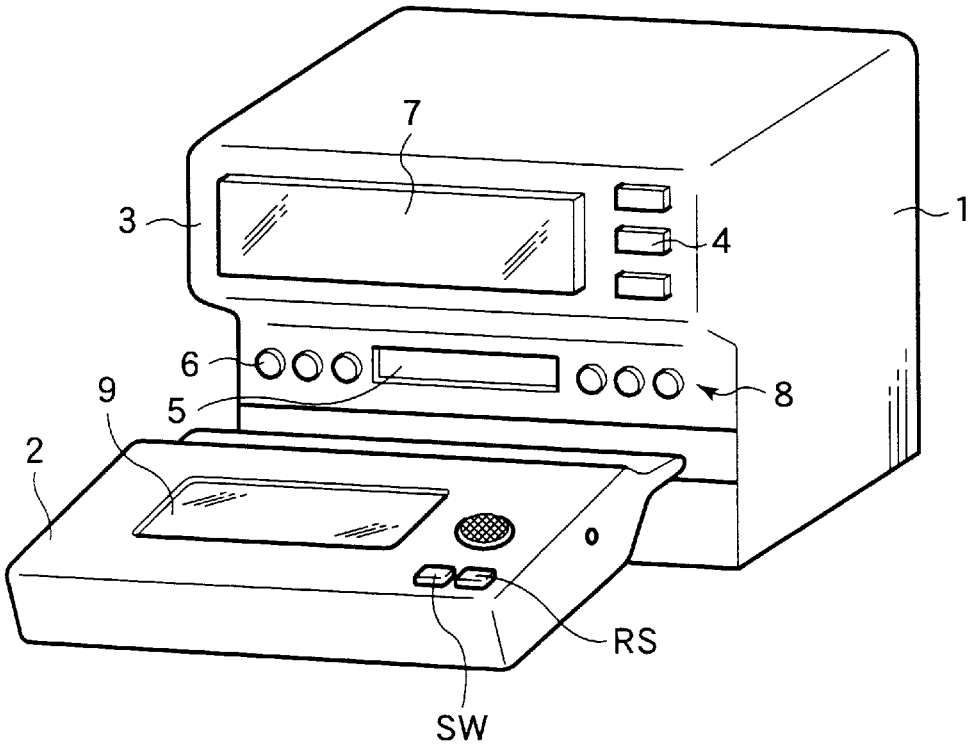
FIG. 1 is a perspective view illustrating the external structure of an electronic appliance to which a display device in accordance with an embodiment of the invention is applied.

FIG. 1 is a perspective view illustrating the external structure of a display device 2 which is tiltably mounted on a main body portion 1 of the electronic apparatus such as a vehicle-mounted audio system or a vehicle-mounted navigation system.

In the drawing, an operation panel 3 is provided on a front surface of the main body portion 1. Provided on the operation panel 3 are, among others, broadcasting-station selection switches 4 for selecting channels of radio broadcasting stations, an insertion port 5 for inserting a recording medium such as a cassette tape, a compact disk (CD), or the like, operation pushbutton switches 6 for effecting such as adjustment of the sound volume, and a fixed display unit for displaying such as the selected channel and the operating condition of an air conditioner mounted in the vehicle. A recessed portion 8 for tiltably accommodating the display device 2 is formed on a lower portion of the operation panel 3.

The display device 2 is called a flap display portion, and a liquid crystal display 9 is provided on a side end portion thereof. Various information is arranged to be displayed on the liquid crystal display 9. For example, at the time when the user performs the setting of desired operation by operating the aforementioned operation pushbutton switches 4 and 6, the setting of operation can be performed while viewing the display information displayed on the liquid crystal display 9.

The display device 2 is tiltably supported by an angle adjusting mechanism 10 which is provided on the main body portion 1 and which will be described later, and the display device 2 is adapted to be accommodated in the recessed portion 8 and to be tilted forward, as shown in FIG. 1, in accordance with an instruction of the user.

Figure 2:
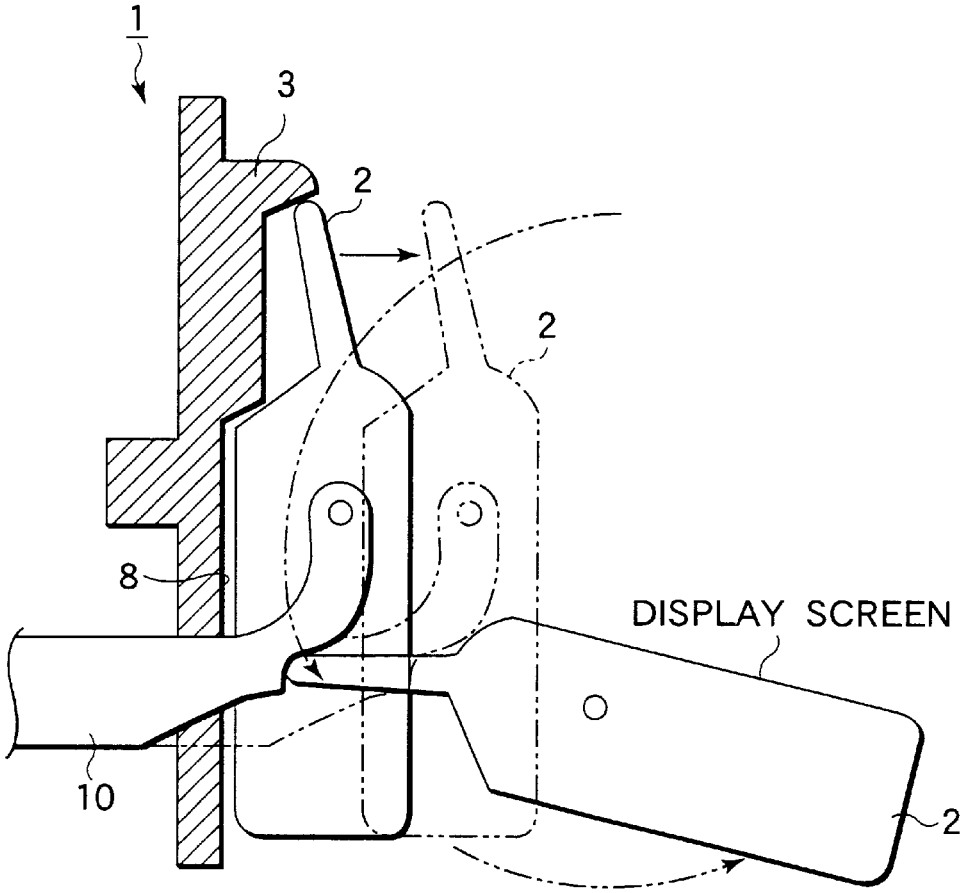
FIG. 2 is a vertical cross-sectional view for explaining the structure and operation of an angle adjusting mechanism for tilting the display device of this embodiment.

More specifically, in the state in which the display device 2 is accommodated in the recessed portion 8 as shown in a vertical cross-sectional view of FIG. 2, if the user operates a predetermined operation pushbutton switch (not shown), the display device 2 is horizontally moved forward by the angle adjusting mechanism 10, and the display device 2, while being rotated counterclockwise, is pulled forward (toward the user side) such that the display surface of the liquid crystal display 9 faces upward.

Further, if the user operates a predetermined operation switch (not shown) in the state in which the display device 2 has been pulled out toward the user side, the angle adjusting mechanism 10 accommodates the display device 2 back into the recessed portion 8 by the reverse operation of the above-described pulling-out operation.

Figure 3:
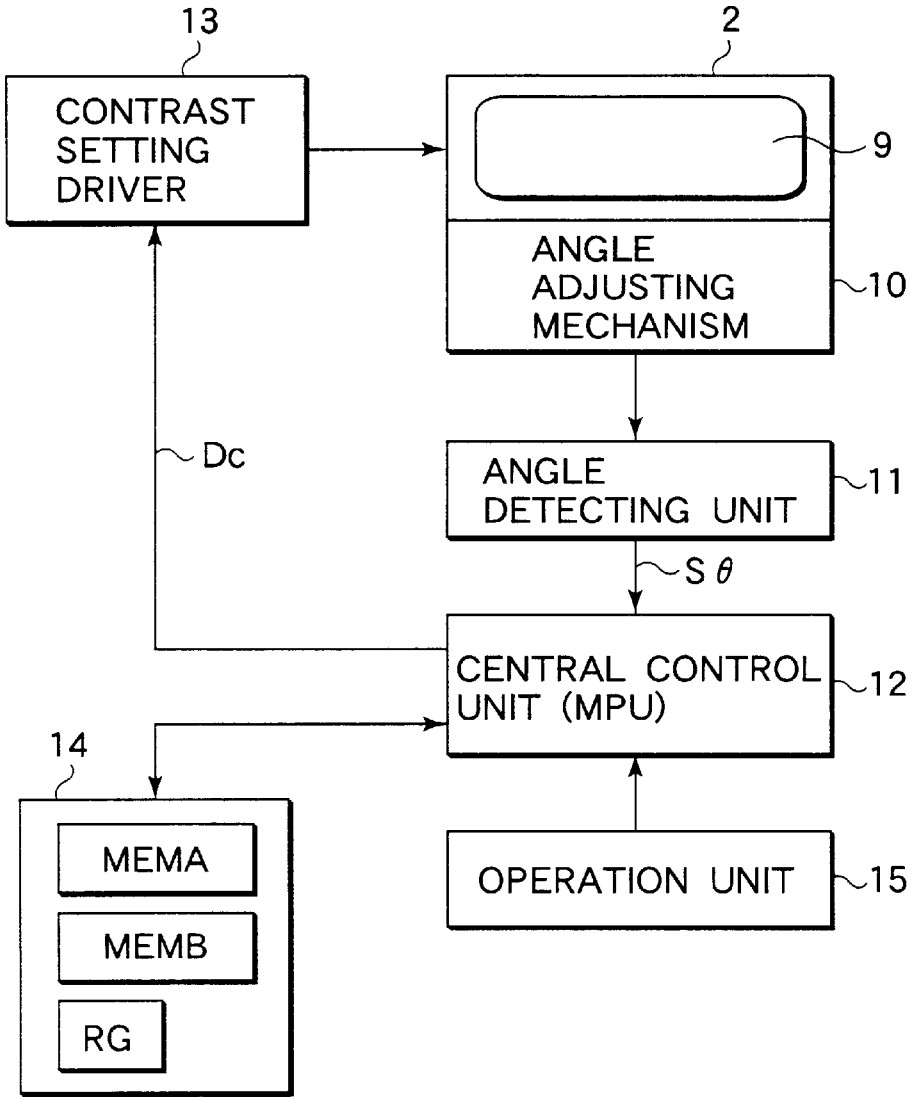
FIG. 3 is a block diagram illustrating the configuration of a contrast setting section provided in the display device of this embodiment.

FIG. 3 is a block diagram illustrating the configuration of a setting section for setting and adjusting the contrast of the liquid crystal display 9 provided on the display device 2.

In the drawing, the display device 2 is tiltably supported by the angle adjusting mechanism 10, and an angle detecting unit 11 for detecting the tilt angle θ i of the display device 2 and outputting its angle detection signal Sθ is provided on a portion of the angle adjusting mechanism 10 for supporting the display device 2 or in the vicinity thereof. Further, a central control unit 12, a contrast setting driver 13, a storage unit 14, and an operation unit 15 are provided. The angle detecting unit 11, the contrast setting driver 13, the storage unit 14, and the operation unit 15 are connected to the central control unit 12.

Here, the contrast setting driver 13 sets the contrast of the liquid crystal display 9 on the basis of contrast data Dc supplied from the central control unit 12.

The storage unit 14 has a storage region MEMA in which standard contrast data MEMA(0), MEMA(1), MEMA(2), . . . are stored in advance as initial value data as shown in a memory map in FIG. 4A, as well as a storage region MEMB in which contrast-adjusted contrast data MEMB(0), MEMB(1), MEMB(2), . . . are stored as shown in a memory map in FIG. 4B, and a storage region RG.

Namely, the storage region MEMA is formed by a read-only memory (ROM), and standard contrast data MEMA(0), MEMA(1), MEMA(2), . . . are stored in advance at memory addresses #0, #1, #2, . . . each corresponding to the tilt angle θi of the display device 2 at the time of product shipment. The storage region MEMB is also adapted to store contrast data MEMA(0), MEMA(1), MEMA(2), . . . at memory addresses #0, #1, #2, . . . each corresponding to the tilt angle θi of the display device 2. Incidentally, the storage regions MEMB and RG are formed by memories having data retaining functions (SDRAMs) or the like, and the same contrast data as that in the storage region MEMA are stored in the storage region MEMB at the time of product shipment.

The central control unit 12 determines the tilt angle θi of the display device 2 on the basis of the angle detection signal Sθ, and reads specific contrast data corresponding to the tilt angle θi by accessing the storage region MEMB on the basis of the result of the determination. Further, the contrast data thus read is supplied to the contrast setting driver 13 as the aforementioned contrast data Dc, thereby setting the contrast of the liquid crystal display 9 to the one corresponding to the tilt angle θi.

In addition, when the user tilts the display device 2 at an arbitrary angle θi and gives an instruction for contrast adjustment through the operation unit 15, the central control unit 12 determines the tilted angle θi on the basis of the angle detection signal Sθ and adjusts (changes) the contrast data in the storage region MEMB corresponding to that angle θi on the basis of the instructed value. Further, the central control unit 12 causes the difference ΔX between the changed contrast data and the standard contrast data corresponding to the aforementioned angle θi to be stored in the storage region RG as an adjustment value X. Further, new contrast data which are obtained by adding the adjustment value ΔX to all the standard contrast data corresponding to the remaining angles other than the angle θi being stored in the storage region MEMA are stored in the storage region MEMB.

The operation unit 15 is comprised of an up/down pushbutton switch SW and a set/reset pushbutton switch RS provided on a side end of the display device 2. If the user presses the set/reset pushbutton switch RS, the central control unit 12 starts the processing of contrast adjustment, and if the user subsequently presses once the portion marked "+" on the up/down pushbutton switch SW, the contrast can be increased by a predetermined amount, whereas if the user presses once the portion marked "−" on the up/down pushbutton switch SW, the contrast can be decreased by a predetermined amount. Accordingly, by pressing the portion marked "+" or "−" on the up/down pushbutton switch SW an arbitrary number of times, the user is able to make desired contrast adjustment, and if the set/reset pushbutton switch RS is finally pressed, the adjusted contrast can be set.

Next, referring to FIGS. 4, 5, and 6, a description will be given of the operation of the contrast setting section having the above-described configuration. Incidentally, FIG. 5 is a flowchart illustrating an example of operation during contrast adjustment which is performed under control by the central control unit 12, and FIG. 6 is a diagram for explaining the basic principle of contrast adjustment.

First, in FIG. 4, as described above, at the time of product shipment, contrast data (contrast data of initial values) which have been set such that the screen which is viewed from a preset eye line (the position of the viewing point) can be always viewed clearly over the entire tilt angle are stored in the storage regions MEMA and MEMB at the respective addresses #0, #1, #2, . . . each corresponding to the tilt angle θi of the display device 2. In addition, the respective contrast data MEMB(O), MEMB(l), MEMB(2), MEMB(3), . . . in the storage region MEMB are also stored in the same way as the contrast data MEMA(0), MEMA(1), MEMA(2), MEMA(3), . . . in the storage region MEMA.

In such a state, during the ordinary displaying operation the central control unit 12 determines the tilt angle θi on the basis of the angle detection signal Sθ, reads the contrast data corresponding to the tilt angle θi in the storage region MEMB, and supplies it to the contrast setting driver 13 as the contrast data Dc shown in FIG. 2, thereby setting the contrast of the liquid crystal display 9 in correspondence with the tilt angle θi. For example, if the user has tilted the display-device 2 at an angle $\theta_1$, the contrast of the liquid crystal display 9 is automatically set on the basis of the contrast data MEMB(1) stored at the address #1 of the storage region MEMB.

Figure 5:
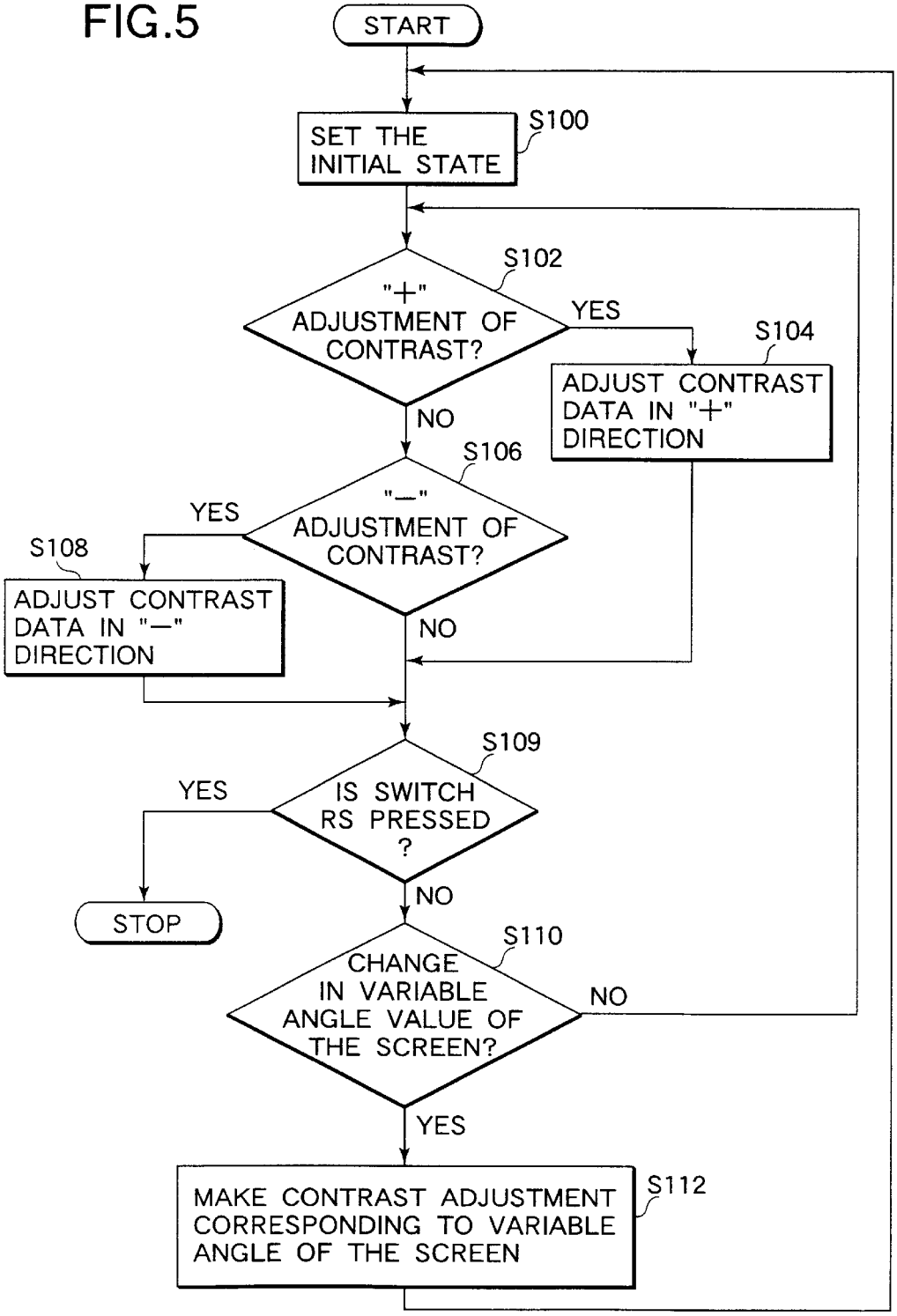
FIG. 5 is a flowchart for explaining an example of operation during contrast adjustment in accordance with the embodiment.
Figure 6:
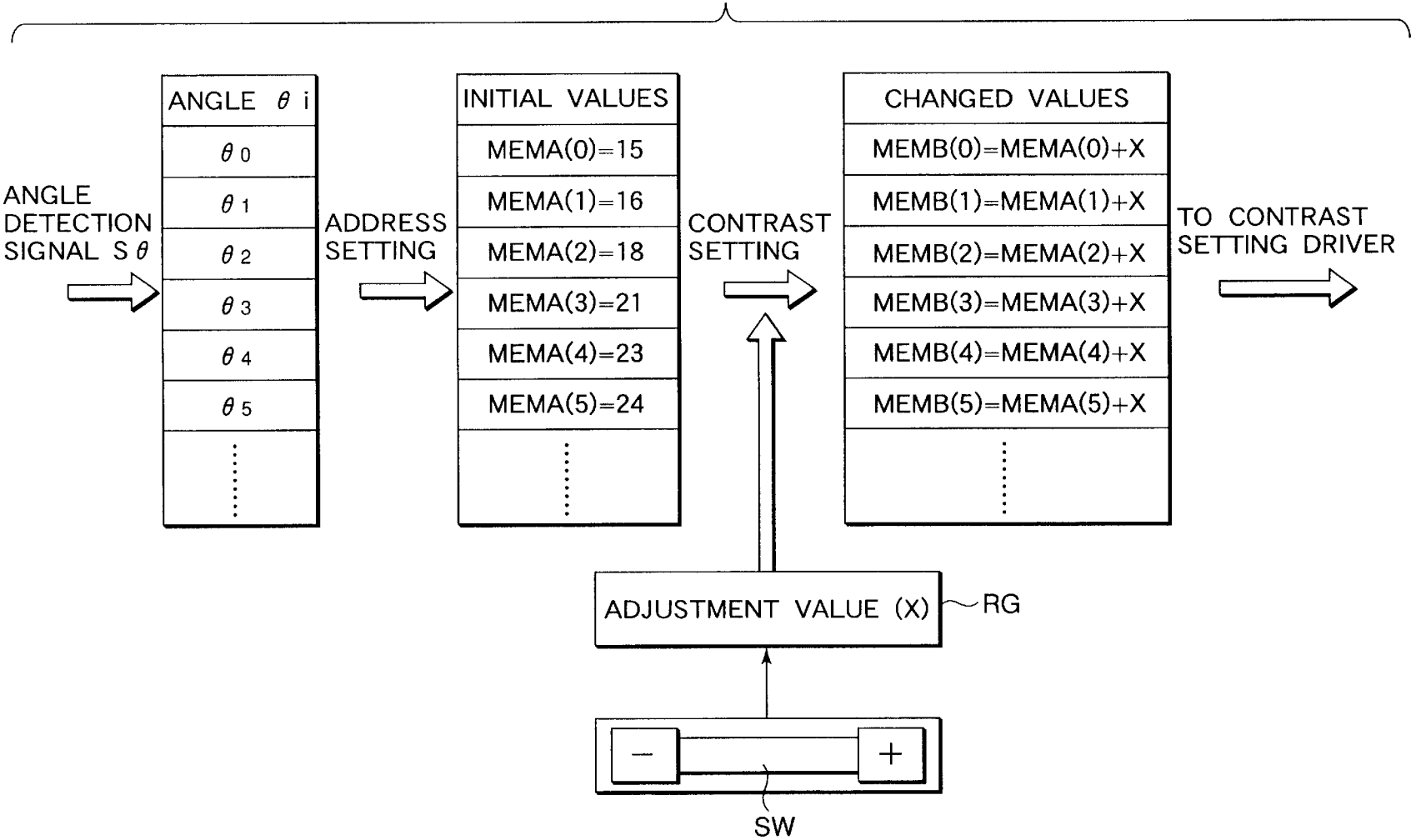
FIG. 6 is an diagram for explaining the basic principle of contrast adjustment in accordance with the embodiment.

If the user presses the set/reset pushbutton switch RS in the course of time when an ordinary display is being given in correspondence with the tilt angle θi, contrast adjustment based on the flowchart shown in FIG. 5 is started.

First, in Step S100, the angle detecting unit 11 detects the present tilt angle θi, and the central control unit 12 stores the contrast data MEMA(i) corresponding to the tilt angle θi in the storage region RG as the adjustment value X. As a specific example, in a case where the user has set the display device 2 at an angle $\theta_2$ for the purpose of adjustment, the contrast data MEMA(2) shown in FIG. 6 is stored temporarily in the storage region RG. Further, the contrast of the liquid crystal display 9 is set on the basis of the adjustment value X.

Next, in Step S102, a determination is made as to whether or not the portion marked "+" on the up/down pushbutton switch SW has been pressed, and if it has been pressed (in the case of "YES"), in Step S104 the adjustment value X is increased by a predetermined value ΔCN, and the contrast of the liquid crystal display 9 is set on the basis of a new adjustment value X (=X+ΔCN).

Meanwhile, if a determination is made in Step S102 that the portion marked "+" has not been pressed, a determination is made in Step S106 as to whether or not the portion marked "−" has been pressed, and if it has been pressed (in the case of "YES"), in Step S108 the adjustment value X is decreased by the predetermined value ΔCN, and the contrast of the liquid crystal display 9 is set on the basis of a new adjustment value X (=X−ΔCN)

Next, in Step S109, a determination is made as to whether or not the set/reset pushbutton switch RS has been pressed. Namely, if the pressing operation of the set/reset pushbutton switch RS has been effected for the second time (in the case of "YES"), the contrast adjustment performed up till then is determined to terminate the contrast adjustment processing, and the normal displaying operation is effected in the adjusted state. In Step S109, if the set/reset pushbutton switch RS has not been pressed (in the case of "NO") , the operation proceeds to Step S110.

In Step S110, the central control unit 12 determines whether or not the display device 2 has been tilted at another angle. If the display device 2 has not been tilted at another angle (in the case of "NO"), the operation returns to the processing starting with Step S102. Accordingly, until the user gives a definite instruction by means of the set/reset pushbutton switch RS in Step S109, the user is able to perform appropriate contrast adjustment with respect to the angle θi set in Step S100 by appropriately operating the up/down pushbutton switch SW. Namely, by pressing the portion marked "+" on the up/down pushbutton switch SW an appropriate number of times, the user is able to increase the contrast adjustment value to a value proportional to ΔCN, and by pressing the portion marked "−" an appropriate number of times, the user is able to decrease the contrast adjustment value to a value proportional to ΔCN. Further, by pressing the portion marked "+" or "−" an appropriate number of times, the user is able to make fine adjustment.

In Step S110, if the display device 2 has been tilted at another angle (in the case of "YES"), the operation proceeds to Step S112. In Step S112, the difference ΔX between the adjustment value X in the storage region RG and the contrast data MEMA(i) corresponding to the angle θi concerning which contrast adjustment has been made, and this difference ΔX is stored as the adjustment value X in the storage region RG. Further, the adjustment value X (=ΔX) is added to all the contrast data in the storage region which correspond to the remaining variable angles other than the angle θi, and the newly obtained contrast data are stored in the storage region MEMB.

For example, when the screen has become invisible at the angle $\theta_2$ in FIG. 6 due to the fact that the user has changed his or her eye line, the user makes contrast adjustment so that the angle of visibility of the screen is brought to the position of the new eye line. If the new contrast data corresponding to that angle $\theta_2$ is adjusted to, for instance, 22 by means of the up/down pushbutton switch SW, the difference ΔX becomes 4 (=22−18), and this value of the difference ΔX is stored in the storage region RG as the adjustment value X. Further this adjustment value X (ΔX) is added to the remaining contrast data MEMA(0), MEMA(1), MEMA(3), MEMA(4), . . . . Then, the newly obtained contrast data MEMA(0)+X, MEMA(1)+X, MEMA(3)+X, MEMA(4)+X, . . . are stored in the storage region MEMB in correspondence with the respective angles. It should be noted that if the difference ΔX has become a negative value, subtraction is practically performed on the basis of the difference ΔX as the aforementioned addition operation.

Accordingly, once the user performs contrast adjustment with respect to one desired angle θi, the results of adjustment are automatically reflected on the contrast at the remaining tilt angles. As a result, contrast adjustment for all the tilt angles is completed, and the screen, when viewed from the position of a new eye line, can always be seen clearly over the entire tilt angle.

Then, upon completion of Step S112, the operation returns to the processing starting with Step S100 again. In consequence, when it has been impossible to make desired contrast adjustment, and when an attempt is made to make readjustment by setting the display device 2 at another tilt angle, it is possible to repeat the operation for contrast adjustment in a manner similar to the one described above.

Thus, in this embodiment, excellent operational efficiency can be offered since the arrangement provided is such that once the user performs contrast adjustment with respect to a desired angle, appropriate contrast adjustment can be automatically effected with respect to the remaining angles as well. In addition, it is possible to overcome the problem of the prior art that the viewing position of the user can be offset while individual adjustment is being made for each angle, and appropriate contrast adjustment cannot be made as a result. Therefore, it is possible to offer the advantage that contrast adjustment can be made very easily by the user.

Furthermore, in this embodiment, the arrangement provided is such that the above-described contrast adjustment can be made automatically by adjusting the amplitude of the drive signal supplied to the display electrodes provided on the display surface of the liquid crystal display 9 on the basis of the contrast data in the storage region MEMB. However, the appropriate display screen is not realized in all directions for the user by the mere adjustment of the contrast alone. Namely, not only is a clear display screen offered in all directions by automatically setting appropriate contrast in correspondence with the tilt angle θi of the display screen, but a clear display screen is offered in all directions by automatically setting (adjusting) the angle of visibility of the liquid crystal display 9 to an appropriate direction in correspondence with the tilt angle θi of the display screen.

Hereafter, referring to FIGS. 7A and 7B which are diagrams explaining the basic principle, a description will be given of the basic principle which makes a clear display screen realizable by adjusting the direction of the angle of visibility.

The liquid crystal display 9 has a structure for adjusting the brightness of the display screen by adjusting the orientation of liquid crystal molecules. FIGS. 7A to 7C schematically show a case in which one liquid crystal molecule LQ is viewed microscopically by way of example. In addition, the drawings show cases in which the orientation of the liquid crystal molecule LG with respect to the display screen has respectively changed when the display screen of the liquid crystal display 9 is viewed macroscopically.

Figure 7A:
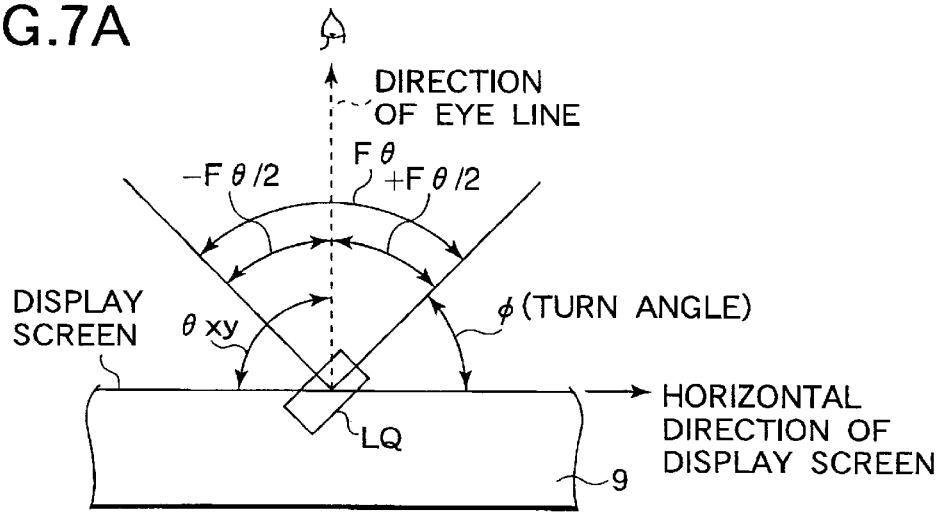
FIGS. 7A to 7C are diagrams for explaining the basic principle of angle-of-visibility adjustment in this embodiment.

First, in FIG. 7A, it is assumed that the angle of visibility is Fθ (in the range of −Fθ/2 to +Fθ/2) when the contrast is adjusted such that the display screen can be viewed most clearly when the user's eye line is at an angle θxy orthogonal to the display screen (θxy=90∞). The orientation of the liquid crystal molecule LQ at this time will be referred to as a turn angle ϕ with respect to the direction of the horizontal plane of the display screen.

Figure 7B:
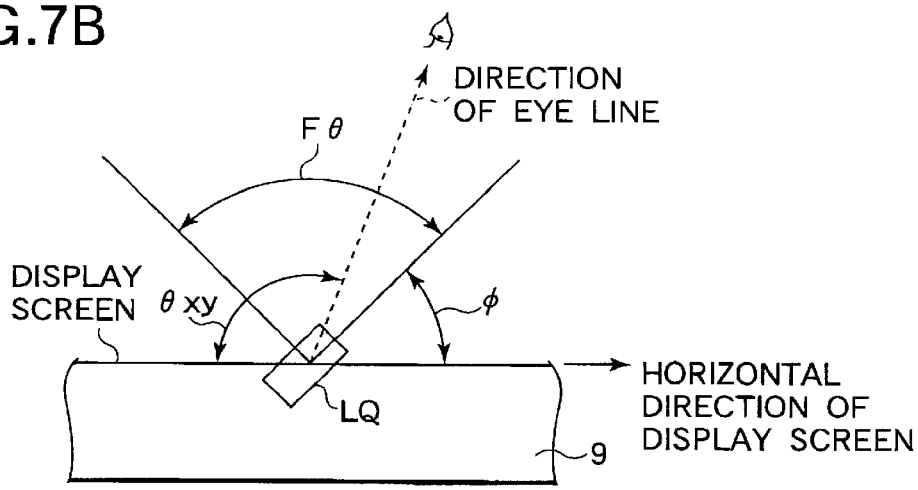
Figure 7C:
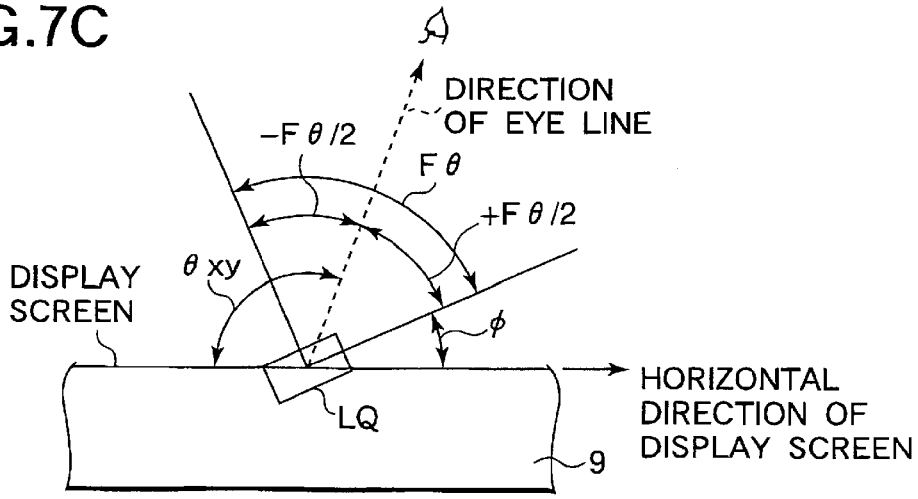
Figure 8:
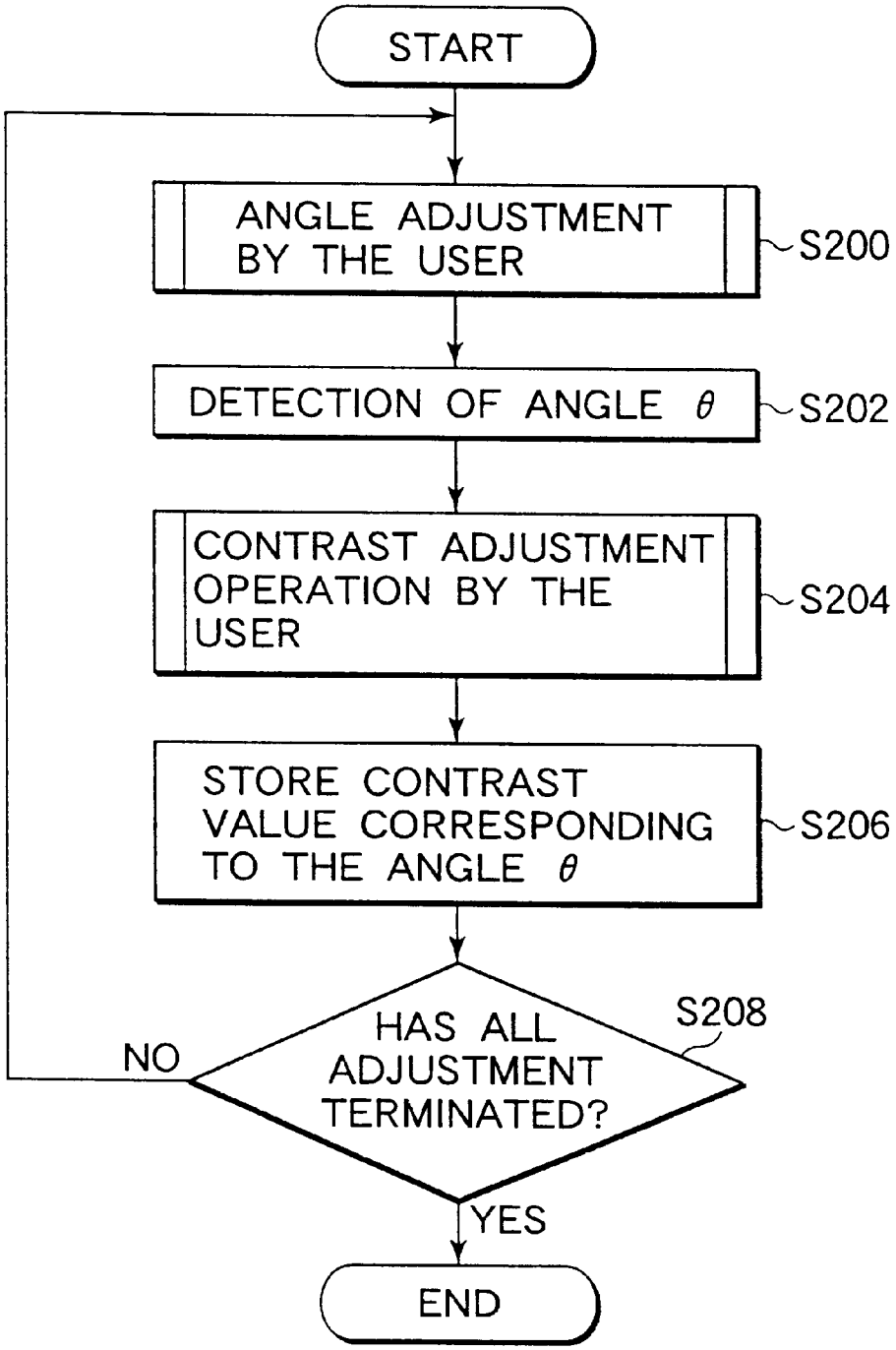
FIG.8 PRIOR ART
FIG. 8 is a flowchart for explaining the conventional contrast adjustment operation.

In such a state, when the angle θxy formed by the display screen and the direction of the user's eye lie is tilted from 90∞ and becomes, for example, θxy>90∞ as shown in FIG. 7B, the visibility of the display screen becomes lower than in the case of FIG. 7A owing to the phenomenon of the gradation inversion of the liquid crystal molecule LG. Namely, even if the orientation of the liquid crystal molecule LG has been set such that optimum brightness can be obtained in the case of FIG. 7A, if the angle formed by the direction of the user's eye line ad the liquid crystal molecule LG changes, there occurs the drawback that the visibility declines due to the aforementioned phenomenon of gradation inversion, as shown in FIG. 7B.

In this embodiment, however, the orientation of the liquid crystal molecule LG is adjusted appropriately by automatically adjusting the contrast as described above, thereby overcoming the above-described drawback of the decline in visibility. Namely, when the angle formed by the display screen and the user's eye line assumes the state shown in FIG. 7B, the orientation of the liquid crystal molecule LG is adjusted as shown in FIG. 7C, so that the positional relationship between the user's eye line and the liquid crystal molecule LG is made similar to that shown in FIG. 7A, thereby realizing a clear display screen similar to that of FIG. 7A.

More specifically, when the user has tilted the display device 2, if the angle θxy formed by the direction of the user's eye line and the display screen of the liquid crystal display 9 has changed, the orientation of the liquid crystal molecule LG with respect to the display screen is adjusted appropriately on the basis of the contrast data MEMB(i) corresponding to the tilt angle θi of the display device 2. Accordingly, by appropriately adjusting the turn anglef of the liquid crystal molecule LG with respect to the direction of the horizontal plane of the display screen, the overall angle of visibility Fθ is oriented in an appropriate direction in correspondence with the angle θxy (i.e., the tilt angle θi of the display device 2). As a result, a clear display screen is realized in all directions not only by appropriately adjusting the contrast in correspondence with the tilt angle θi of the display device 2 but also by automatically adjusting the direction of the angle of visibility.

Thus, in accordance with this embodiment, since the angle of visibility is also adjusted automatically, it is possible to provide a very clear display screen.

It should be noted that although, in the above-described embodiment, contrast adjustment is made for all the variable angles by determining the difference Δx between the contrast data MEMA(i) corresponding to the angle θi set by the user and the contrast data after adjustment, and by adding this difference ΔX to the contrast corresponding to the remaining angles, the invention is not limited to the same.

For example, an arrangement may be provided such that after the contrast data MEMB(i) is adjusted in correspondence with the angle θi set by the user, a ratio K (=MEMB (i)/MEMA(i)) between the contrast data MEMB(i) and the standard contrast data MEMA(i) in the storage region MEMA corresponding to that angle θi, and the respective standard contrast data corresponding to the remaining angles are multiplied by this ratio K, thereby setting the contrast data MEMB(0), MEMB(1), MEMB(2), . . . corresponding to all the variable angles.

In addition, although, in the above-described embodiment, a description has been given of the case in which the display device 2 is tilted in one direction as a typical example, the display device 2 may be rotated three-dimensionally by the angle adjusting mechanism 10, and the angle of the liquid crystal display 9 with respect to the angle adjusting mechanism 10 may be detected by the angle detecting unit 11 as information on two-dimensional coordinates (XY coordinates) or three-dimensional coordinates (XYZ coordinates). Further, the respective contrast data stored in the storage regions MEMA, MEMB, and RG provided in the storage unit 14 may be stored as their coordinate information, and may be also used as their coordinate information at the time of contrast adjustment to effect the above-described contrast adjustment, thereby making it possible to adjust the contrast of the liquid crystal display 9 in all the directions.

In addition, although a section is provided in which the contrast data as initial values are stored in advance in the storage region MEMA, and the contrast data after adjustment are stored in the storage region MEMB, an arrangement may be provided such that each time the tilt angle θi changes, the contrast data MEMA(i) which has been read from the storage region MEMA in correspondence with that tilt angle θi is subjected to processing such as the addition of the adjustment value X (ΔX) stored in the storage region RG, thereby making appropriate adjustment corresponding to that tilt angle θi . According to such an arrangement, since the storage region MEMB can be omitted, it is possible to realize the simplification of the circuit configuration.

In addition, the invention is applicable not only to the contrast adjustment of the liquid crystal display, but may be applied widely to other display devices such as CRT displays and plasma display panels (PDPs).

As described above, in accordance with the invention, if the user or the like tilts the display screen at a desired angle and gives an instruction for adjustment of the angle of visibility, the angle of visibility is adjusted on the basis of the information on the angle of visibility corresponding to that angle, and the information on the angle of visibility corresponding to other angles is adjusted on the basis of the adjustment value used when the angle-of-visibility adjustment was made at the aforementioned angle, thereby automatically making the angle-of-visibility adjustment corresponding to the other angles. Accordingly, by merely instructing the angle-of-visibility adjustment with respect to one angle, the user or the like is able to make the angle-of-visibility adjustment for the remaining angles as well, thereby making it possible to perform angle-of-visibility adjustment with a simple operation.

What is claimed is:

1. A display device which has a display screen and is supported by an angle adjusting mechanism, comprising:

a detecting section for detecting an angle formed by said display screen and said angle adjusting mechanism; and a setting section for setting an angle of visibility of said display screen on the basis of information on an angle of visibility corresponding to the angle detected by said detecting section, wherein in a state in which said display screen is set to one angle with respect to said angle adjusting mechanism, said setting section adjusts the angle of visibility at said one angle by adjusting the information on an angle of visibility corresponding to said one angle, and subsequently and automatically adjusts the information on an angle of visibility corresponding to remaining angles, so as to automatically adjust the angles of visibility corresponding to the remaining angles, and wherein after adjusting the information on an angle of visibility corresponding to said one angle, said setting section adjusts the information on an angle of visibility corresponding to the remaining angles on the basis of an adjustment value of the information on an angle of visibility corresponding to said one angle as well as initial values which are preset in correspondence with respective variable angles of said display screen.

2. The display device according to claim 1, wherein said display device has said display screen based on a liquid crystal display, and said setting section adjusts the orientation of the angle of visibility of said liquid crystal display.

3. A display device which has a display screen and is supported by an angle adjusting mechanism, comprising:

a detecting section for detecting an angle formed by said display screen and said angle adjusting mechanism; and a setting section for setting an angle of visibility of said display screen on the basis of information on contrast corresponding to the angle detected by said detecting section, wherein in a state in which said display screen is set to one angle with respect to said angle adjusting mechanism, said setting section adjusts the angle of visibility at said one angle by adjusting the information on contrast corresponding to said one angle, and subsequently and automatically adjusts the information on contrast corresponding to remaining angles, so as to automatically adjust the angles of visibility corresponding to the remaining angles, and wherein after adjusting the information on contrast corresponding to said one angle, said setting section adjusts the information on an angle of visibility corresponding to the remaining angles on the basis of an adjustment value of the information on an angle of visibility corresponding to said one angle as well as initial values which arc preset in correspondence with respective variable angles of said display screen.

4. The display device according to claim 3, wherein said display device has said display screen based on a liquid crystal display, and said setting section adjusts the orientation of the angle of visibility of said liquid crystal display.

5. A display device which has a display screen and is supported by an angle adjusting mechanism, comprising:

a detecting section for detecting an angle formed by said display screen and said angle adjusting mechanism; and a setting section for setting a contrast of said display screen on the basis of information on contrast corresponding to the angle detected by said detecting section, wherein in a state in which said display screen is set to one angle with respect to said angle adjusting mechanism, said setting section adjusts the contrast at said one angle by adjusting the information on contrast corresponding to said one angle, and subsequently and automatically adjusts the information on contrast corresponding to remaining angles, so as to automatically adjust the contrast corresponding to the remaining angles, and wherein after adjusting the information on contrast corresponding to said one angle, said setting section adjusts the information on contrast corresponding to the remaining angles on the basis of an adjustment value of the information on contrast corresponding to said one angle as well as initial values which are preset in correspondence with respective variable angles of said display screen.

6. A display device which has a display screen and is supported by an angle adjusting mechanism, comprising:

detecting section for detecting an angle formed by said display screen and said angle adjusting mechanism; and setting section for setting an angle of visibility of said display screen on the basis of information on an angle of visibility corresponding to the angle detected by said detecting section, wherein, in a state in which said display screen is set to one angle with respect to said angle adjusting mechanism, said setting section adjusts the angle of visibility at said one angle by adjusting the information on an angle of visibility corresponding to said one angle, and subsequently adjusts the information on an angle of visibility corresponding to remaining angles, so as to automatically adjust the angles of visibility corresponding to the remaining angles, wherein, after adjusting the information on an angle of visibility corresponding to said one angle, said setting section adjusts the information on an angle of visibility corresponding to the remaining angles on the basis of an adjustment value of the information on an angle of visibility corresponding to said one angle as well as initial values which are preset in correspondence with respective variable angles of said display screen, and wherein said setting section effects the adjustment corresponding to the remaining angles by determining a difference between the adjustment value corresponding to said one angle and an initial value corresponding to said one angle among the initial values and by adding the difference to the respective initial values corresponding to the remaining angles.

7. The display device according to claim 6, wherein, when said display screen is set to said one angle with respect to said angle adjusting mechanism and said setting section adjusts the angle of visibility at said one angle by adjusting the information on said angle of visibility corresponding to said one angle, said setting section automatically adjusts the information on said angle of visibility corresponding to said remaining angles.

8. A display device which has a display screen and is supported by an angle adjusting mechanism, comprising:

detecting section for detecting an angle formed by said display screen and said angle adjusting mechanism; and setting section for setting an angle of visibility of said display screen on the basis of information on contrast corresponding to the angle detected by said detecting section, wherein, in a state in which said display screen is set to one angle with respect to said angle adjusting mechanism, said setting section adjusts the angle of visibility at said one angle by adjusting the information on contrast corresponding to said one angle, and subsequently and automatically adjusts the information on contrast corresponding to remaining angles, so as to automatically adjust the angles of visibility corresponding to the remaining angles, wherein, after adjusting the information on contrast corresponding to said one angle, said setting section adjusts the information on an angle of visibility corresponding to the remaining angles on the basis of an adjustment value of the information on an angle of visibility corresponding to said one angle as well as initial values which are preset in correspondence with respective variable angles of said display screen, and wherein said setting section effects the adjustment corresponding to the remaining angles by determining a difference between the adjustment value corresponding to said one angle and an initial value corresponding to said one angle among the initial values and by adding the difference to the respective initial values corresponding to the remaining angles.

9. The display device according to claim 8, wherein, when said display screen is set to said one angle with respect to said angle adjusting mechanism and said setting section adjusts the angle of visibility at said one angle by adjusting the information on said contrast corresponding to said one angle, said setting section automatically adjusts the information on said contrast corresponding to said remaining angles.

10. A display device which has a display screen and is supported by an angle adjusting mechanism, comprising:

detecting section for detecting an angle formed by said display screen and said angle adjusting mechanism; and setting section for setting a contrast of said display screen on the basis of information on contrast corresponding to the angle detected by said detecting section, wherein, in a state in which said display screen is set to one angle with respect to said angle adjusting mechanism, said setting section adjusts the contrast at said one angle by adjusting the information on contrast corresponding to said one angle, and subsequently and automatically adjusts the information on contrast corresponding to remaining angles, so as to automatically adjust the contrast corresponding to the remaining angles, wherein, after adjusting the information on contrast corresponding to said one angle, said setting section adjusts the information on contrast corresponding to the remaining angles on the basis of an adjustment value of the information on contrast corresponding to said one angle as well as initial values which are preset in correspondence with respective variable angles of said display screen, and wherein said setting section effects the adjustment corresponding to the remaining angles by determining a difference between the adjustment value corresponding to said one angle and an initial value corresponding to said one angle among the initial values and by adding the difference to the respective initial values corresponding to the remaining angles.

11. The display device according to claim 10, wherein, when said display screen is set to said one angle with respect to said angle adjusting mechanism and said setting section adjusts the contrast at said one angle by adjusting the information on said contrast corresponding to said one angle, said setting section automatically adjusts the information on said contrast corresponding to said remaining angles.

12. A display device capable of adjusting a visibility angle, comprising:

a display screen that is capable of being oriented at a plurality of angles;

a detector that detects a first angle at which the display screen is oriented;

a control circuit, wherein the control circuit sets a first visibility angle of the display screen corresponding to the first angle detected by the detector, and wherein, after the first visibility angle is set, the control circuit automatically adjusts a second visibility angle of the display screen corresponding to a second angle at which the display screen is oriented based on the first visibility angle; and a memory for storing initial values respectively corresponding to the first angle and the second angle of the display screen, wherein the control circuit sets the first visibility angle by adjusting first visibility angle data corresponding to the first angle, wherein the control circuit determines an adjusting value based on the adjusted first visibility angle data and the initial value of the first angle, wherein the memory stores the adjusting value, and wherein the control circuit automatically adjusts the second visibility angle based on the adjusting value and the initial value of the second angle.

13. A display device capable of adjusting a visibility angle, comprising:

a display screen that is capable of being oriented at a plurality of angles;

a detector that detects a first angle at which the display screen is oriented;

a control circuit, wherein the control circuit sets a first visibility angle of the display screen corresponding to the first angle detected by the detector, and wherein, after the first visibility angle is set, the control circuit automatically adjusts a second visibility angle of the display screen corresponding to a second angle at which the display screen is oriented based on the first visibility angle; and a memory for storing initial values respectively corresponding to the first angle and the second angle of the display screen, wherein the control circuit sets the first visibility angle by adjusting first contrast data corresponding to the first angle, wherein the control circuit determines an adjusting value based on the adjusted first contrast data and the initial value of the first angle, wherein the memory stores the adjusting value, and wherein the control circuit automatically adjusts the second visibility angle based on the adjusting value and the initial value of the second angle.

14. A display device capable of adjusting a contrast, comprising:

a display screen that is capable of being oriented at a plurality of angles;

a detector that detects a first angle at which the display screen is oriented;

a control circuit, wherein the control circuit sets a first contrast of the display screen corresponding to the first angle detected by the detector, and wherein, after the first contrast is set, the control circuit automatically adjusts a second contrast of the display screen corresponding to a second angle at which the display screen is oriented based on the first contrast, and a memory for storing initial values respectively corresponding to the first angle and the second angle of the display screen, wherein the control circuit sets the first contrast by adjusting first contrast data corresponding to the first angle, wherein the control circuit determines an adjusting value based on the first contrast data and the initial value of the first angle, wherein the memory stores the adjusting value, and wherein the control circuit automatically adjusts the second contrast based on the adjusting value and the initial value of the second angle.

15. A method for adjusting a visibility angle to a display device having a display screen, comprising:

(a) adjusting an angle of the display screen;

(b) detecting a first angle at which the display screen was adjusted in said operation (a);

(c) setting a first visibility angle of the display screen corresponding to the first angle detected at said operation (b); and (d) automatically adjusting a second visibility angle of the display screen corresponding to a second angle of the display screen based on the first visibility angle after said operation (c), wherein the display device has a memory for storing initial values respectively corresponding to the first angle and the second angle of the display screen, wherein said operation (c) comprises:

(c1) adjusting first visibility angle data corresponding to the first angle;

(c2) setting the first visibility angle based on the first visibility angle data adjusted in said operation (c1);

(c3) determining an adjusting value based on the first visibility angle data and the initial value of the first angle; and (c4) storing the adjusting value, and wherein said operation (d) comprises:

(d1) adjusting the second visibility angle based on the adjusting value and the initial value of the second angle.

16. A method for adjusting a visibility angle to a display device having a display screen, comprising:

(a) adjusting an angle of the display screen;

(b) detecting a first angle at which the display screen was adjusted in said operation (a);

(c) setting a first visibility angle of the display screen corresponding to the first angle detected at said operation (b); and (d) automatically adjusting a second visibility angle of the display screen corresponding to a second angle of the display screen based on the first visibility angle after said operation (c), wherein the display device has a memory for storing initial values respectively corresponding to the first angle and the second angle of the display screen, wherein the operation (c) comprises:

(c1) adjusting first contrast data corresponding to the first angle;

(c2) setting the first visibility angle based on the first contrast data adjusted in said operation (c1);

(c3) determining an adjusting value based on the first contrast data and the initial value of the first angle;

(c4) storing the adjusting value, and wherein the operation (d) comprises:

(d1) adjusting the second visibility angle based on the adjusting value and the initial value of the second angle.

17. A method for adjusting a contrast to a display device having a display screen, comprising:

(a) adjusting an angle of the display screen;

(b) detecting a first angle of the display screen adjusted in said operation (a);

(c) setting a first contrast of the display screen corresponding to the first angle detected at said operation (b); and (d) automatically adjusting a second contrast of the display screen corresponding to a second angle of the display screen based on the first contrast after said operation (c), wherein the display device has a memory for storing initial values respectively corresponding to the first angle and the second angle of the display screen, wherein said operation (c) comprises:

(c1) adjusting first contrast data corresponding to the first angle;

(c2) setting the first contrast based on the first contrast data adjusted in said operation (c1);

(c3) setting an adjusting value based on the first contrast data and the initial value of the first angle;

(c4) storing the adjusting value; and wherein said operation (d) comprises:

(d1) automatically adjusting the second contrast based on the adjusting value and the initial value of the second angle.

* * * * *